United States Patent [19]

Tonhäuser

[11] 4,071,969

[45] Feb. 7, 1978

[54] COLLAPSIBLE DISPLAY ELEMENTS

[76] Inventor: Harry L. Tonhäuser, Pilgramstrasse 2, 7100 Heilbronn, Germany

[21] Appl. No.: 587,659

[22] Filed: June 17, 1975

[30] Foreign Application Priority Data

Oct. 15, 1974 Germany ..... 7434417[U]

[51] Int. Cl.[2] ..... G09F 1/00

[52] U.S. Cl. ..... 40/610

[58] Field of Search ..... 248/472, 458; 40/124.1, 40/126 A, 125 H

[56] References Cited

U.S. PATENT DOCUMENTS

| | | | |
|---|---|---|---|
| 1,499,891 | 7/1924 | Storer | 40/124.1 |
| 2,345,913 | 4/1944 | Bishop | 40/125 H |
| 2,373,778 | 4/1945 | Quimby | 40/125 H |
| 3,057,095 | 10/1962 | Foreman | 40/124.1 |
| 3,322,382 | 5/1967 | Rohrbach | 40/125 H |
| 3,481,061 | 12/1969 | Julin | 40/124.1 |
| 3,685,666 | 8/1972 | Rose | 40/125 H |
| 3,766,675 | 10/1973 | Leigh | 40/126 A |

*Primary Examiner*—Russell R. Kinsey
*Assistant Examiner*—Wenceslao J. Contreras
*Attorney, Agent, or Firm*—Craig & Antonelli

[57] ABSTRACT

Display elements are used to convey a distinct and demonstrative impression of an article and/or an advertising offer. Thus, this element serves for advertising purposes and must have a correspondingly attractive appearance. However, for convenient storage and transportation, the element should occupy a minimum of space. Consequently, this invention relates to a collapsible or foldable display element with at least one display carrier for the visible support of the displayed article. Supports arranged on both sides serve for setting the element up on a surface. High dimensional rigidity and attractive appearance are imparted to this display element by providing that this element consists at least partially of tubular members fashioned as a flat sleeve or as a three-dimensional, collapsible unit. By hinged connection of the individual parts, a high spatial concentration is attained with a concomitantly simple manipulation when setting up the element.

20 Claims, 18 Drawing Figures

COLLAPSIBLE DISPLAY ELEMENTS

This invention relates to a collapsible display element consisting of at least one display carrier for the visible support of the displayed article with supports arranged on both sides for setting the element up on a surface.

Display elements are to convey to an observer a distinct and demonstrative picture of an article or an advertising offer. Products can be directly displayed, or they can be illustrated and described by pictures and words in the form of offers, for example, travel advertisements. For this reason, the display element must not only have an attractive appearance but also must frequently be constructed of a relatively large size to attract the necessary attention. For transporting purposes, such display elements must, therefore, be folded up. However, this must include the assurance that the display elements can be unfolded and set up with only a few manipulations and in a simple manner even by unskilled personnel. Finally, the display element must not only have a pleasing appearance but also must retain its given, attractive shape during fluctuating atmospheric influences, such as during exposure to the effects of temperature and moisture.

Therefore, it is an object of the present invention to improve the construction of display elements so that they can be easily set up, have a simple structure, and retain the initially imparted attracted appearance with certainty.

This object is attained by the invention by fashioning the display carrier as a tubular unit consisting of flat material, the supports being foldably joined to this unit by means of fishplates or tongues.

A high standing stability of the supports is attained, according to a further feature of the invention, by forming the supports as flat, tubular members consisting of flat material.

According to another feature of the invention, the display carrier is fashioned as a collapsible box, the walls of which are hingedly linked together at the top and at the bottom by means of horizontal webs or crosspieces.

A high stability, when the element is set up, is attained according to a further feature of this invention by connecting the supports elastically with each other by means of a tension spring extending through the display carrier.

Additional features of the invention can be seen from the following description and claims.

The advantages attained by this invention reside particularly in that the display carrier and the supports form a unit which can be folded-up flat for transporting and storing purposes and is unfolded into the predetermined position for setting up purposes by means of few manipulations. Due to the fact that the display carrier and the supports are fashioned as a tubular unit, a simple structure is obtained which accordingly can also be manufactured in a simple manner. The individual parts of the display element are inherently relatively rigid members even in the form of flat tubular elements, but convey a solid three-dimensional impression with their appearance. Consequently, display elements according to this invention are economical in their manufacture, simple in their handling, and effectively promote sales in their use.

Embodiments of the invention are illustrated in the drawing without limitation and will be described in greater detail below, to wit:

Figure 1:
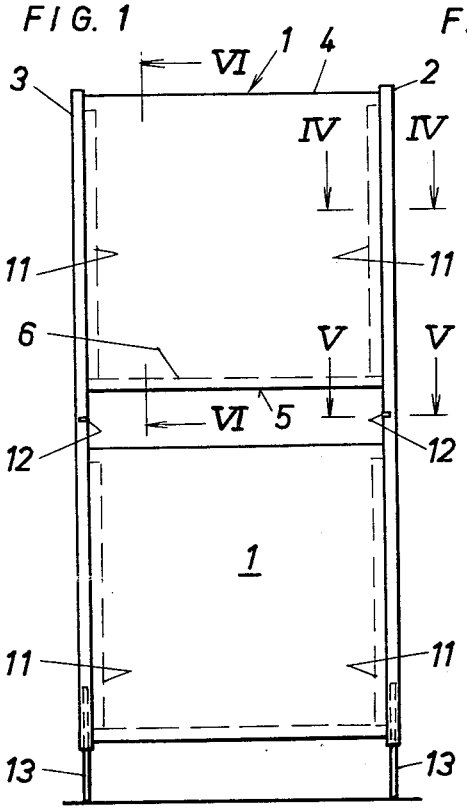
FIG. 1 shows a front view of the display element.
Figure 2:
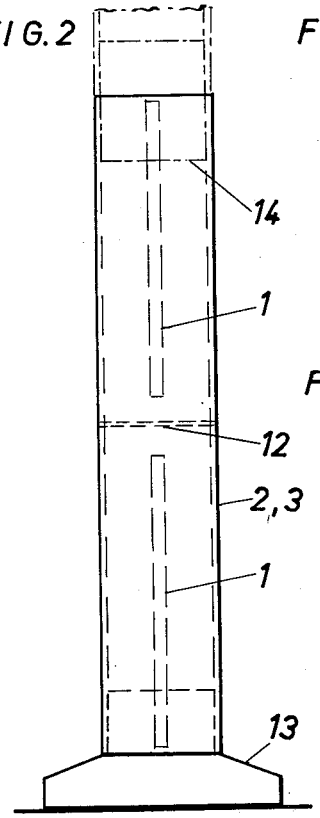
FIG. 2 shows a lateral view of the display element of FIG. 1.
Figure 6:
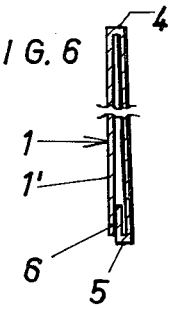
FIG. 6 shows a sectional view along line VI—VI of FIG. 1.

The display element of FIGS. 1 and 2 consists of two superimposed display carriers 1 joined together on both sides by means of collapsible supports 2 and 3. Any desired advertising poster with a sales-promotion text and/or an illustration can be mounted on the wall surfaces of the display carrier 1. The latter consists of a flat material, preferably cardboard or plastic, such as synthetic resin, bent over along the top edge 4 and the bottom edge 5 so that a flat, rectangular cross-section tube is produced preferably sealed by means of an adhesive strip 6 in the proximity of the bottom edge 5 (FIG. 6), and having a flat surface 1' for carrying a poster or the like.

Figure 4:
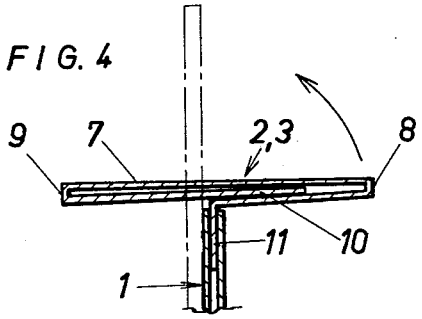
FIG. 4 shows a sectional view along line IV—IV of FIG. 1.

In the same way, the supports 2 and 3 also form flat, tubular members 7 of cardboard, or a similar flat material, which is bent at an angle along the front edge 8 and the rear edge 9, wherein the two ends represent an overlapping section 10 wherein they are, for example, glued together. The side with the overlapping section 10 represents the inside of the supports 2 and 3 facing the display carrier 1. The end of the flat member 7 at the overlapping section 10, which is respectively on the outside, is equipped preferably in the center of the supports 2 and 3 with a tongue 11 hingedly bent at an angle in the manner of a hinge; this tongue is inserted in the lateral, slot-shaped aperture of the display carrier 1 and is joined to the latter. The supports 2 and 3 can thus be folded from the position shown in FIG. 4 into the position indicated in dot-dash lines, so that a flat, stackable element is produced suitable for transportation.

Figure 3:
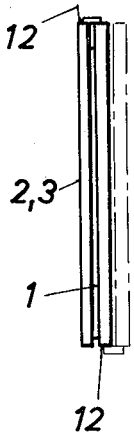
FIG. 3 shows a lateral view of the collapsed display element.

It is possible to provide two or more display carriers 1 one above the other between continuous supports 2 and 3. For purposes of transportation, these supports 2 and 3 can be collapsed additionally about horizontal axes disposed between the display carriers 1, as shown in FIG. 3. If more than two display carriers 1 are present, the folding step can be executed in a zig-zag shape as indicated in dot-dash lines. The collapsing action is made possible by a cutout 12 through one wall side of the supports 2 and 3. The mutually opposed cutouts 12 in the supports 2 and 3 are each arranged symmetrically, i.e. alternatingly on the inside and on the outside, to be able to fold up the supports 2 and 3 correspondingly.

A base section 13 having a foot portion widened as compared to the supports provides sufficient stability; this base section 13 is inserted in the open end of each support 2 and 3 at the bottom, but it can also be formed integrally with the supports 2 and 3.

Figure 7:
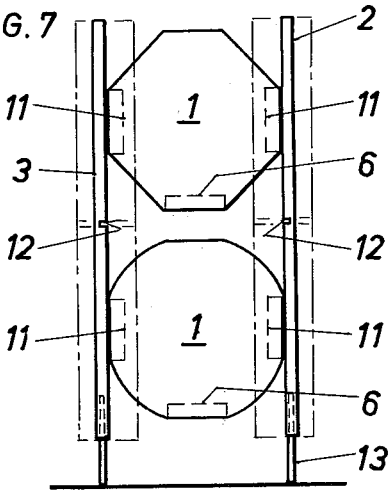
FIG. 7 shows a front view of the set-up display element with differently constructed display carriers.

Several display elements can also be arranged in superimposed relationship, wherein they are joined together by means of connecting pieces 14 inserted in the ends of supports 2 and 3. The surface area of the display carrier 1 can be angular and/or round as desired. Two possible contours are illustrated in FIG. 7.

Figure 8:
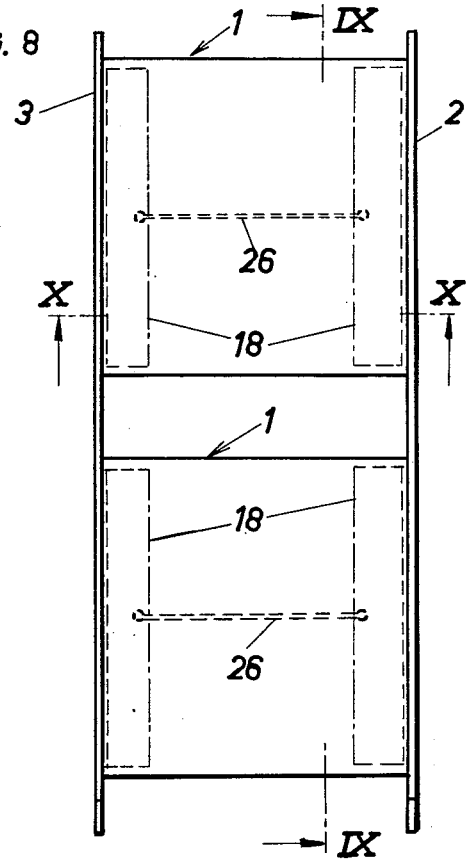
FIG. 8 shows a view of an unfolded display element having a different structure.
Figure 9:
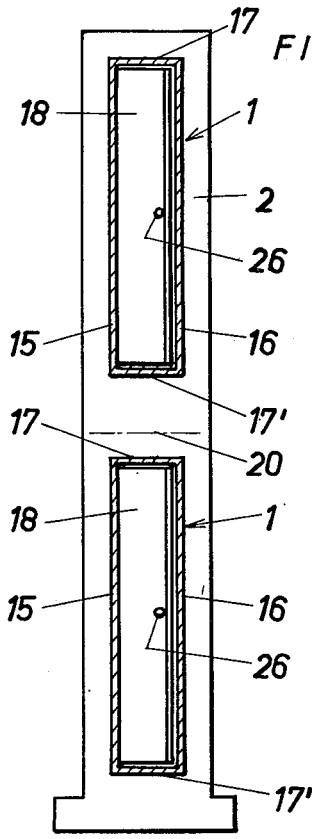
FIG. 9 shows a vertical sectional view along line IX—IX of FIG. 8.
Figure 10:
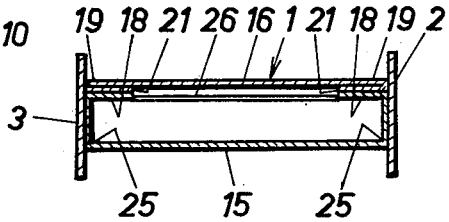
FIG. 10 shows a sectional view along line X—X of FIG. 8.

FIGS. 8 – 10 show a display device with display carriers 1 fashioned as collapsible boxes, the supports 2 and 3 being hingedly joined thereto on both sides. The collapsible boxes consist of a flat material forming a composite of two vertical walls 15 and 16 of rectangular cross-section hingedly joined with each other at the top and at the bottom by means of horizontal webs 17 and 17'. One wall 15 is hingedly joined to the supports 2 and 3 on both sides by respective joints 25. A tension spring 26 or a similar elastic traction means holds the display carrier in the unfolded position as illustrated. The tension spring 26 is joined at its ends to respective connecting fishplates 18 hingedly connected to the adjacent support 2 or 3. The connecting fishplates 18 are furthermore arranged so that they lie in the unfolded condition closely behind the lateral edges 19 of the wall 16 to support the latter on the inside. To collapse the display carrier, the supports 2 and 3 are folded outwardly about the joints 25, and the display carrier 1 is folded together toward the bottom or toward the top. The unfolding step is executed by a correspondingly reversed procedure. The supports 2 and 3 can be additionally folded over about a joint 20.

The connecting fishplates 18 which have approximately the same length as the lateral edges 19 prevent the inward buckling of the latter. The outward bulging of the lateral edges 19 is prevented by reinforcements 21 of glued-on strips of material or of folded-over extension strips of the wall 16, arranged on the backside of the lateral edges 19.

Figure 11:
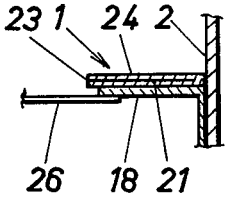
FIG. 11 shows a sectional view along line XI—XI of FIG. 12.
Figure 12:
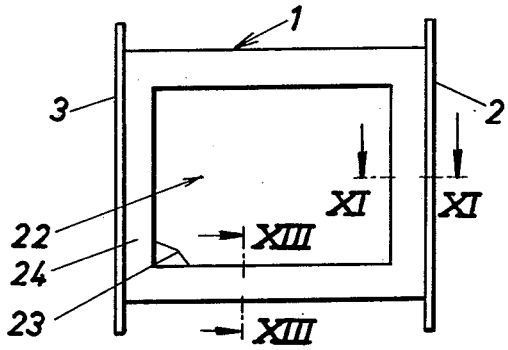
FIG. 12 shows an elevational view of a display element having a window-like cutout.
Figure 13:
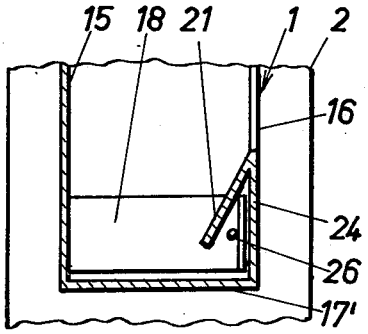
FIG. 13 shows a sectional view along line XIII—XIII of FIG. 12.

A special effect of the display element can furthermore be attained by a window-like aperture or cutout 22 in one or both of walls 15 and/or 16 (see FIGS. 11 – 13). The rims 23 of the frame portions 24 of walls 15 and 16, respectively, which surround the aperture 22, are likewise provided with reinforcements 21. These latter can also be formed as an extension of the frame portion 24 which is folded over and extends to the inner edge and/or the rim 23 of the aperture 22 (FIG. 11). In the last-mentioned embodiment, one tension spring 26 is respectively provided behind the upper and lower frame portions 24 of the aperture 22. To facilitate the collapsing step, the tension spring 26 is arranged in the space between the frame portion 24 and the folded-over extension serving as the reinforcement 21 (FIG. 13). For the same reason, the connecting fishplate 18 is fashioned to be so wide that it still extends underneath the wall 16 even in the collapsed condition of the display element and can slide directly along this wall 16 when the element is subsequently unfolded.

Figure 5:
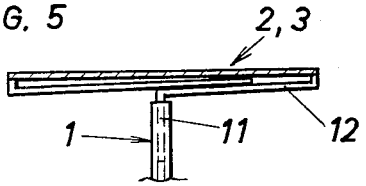
FIG. 5 shows a sectional view along line V—V of FIG. 1.
Figure 14:
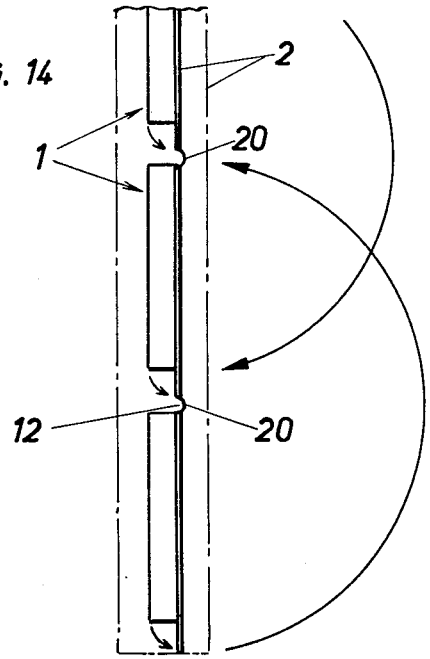
FIG. 14 shows a lateral view of a display element collapsible in one folding direction.
Figure 15:
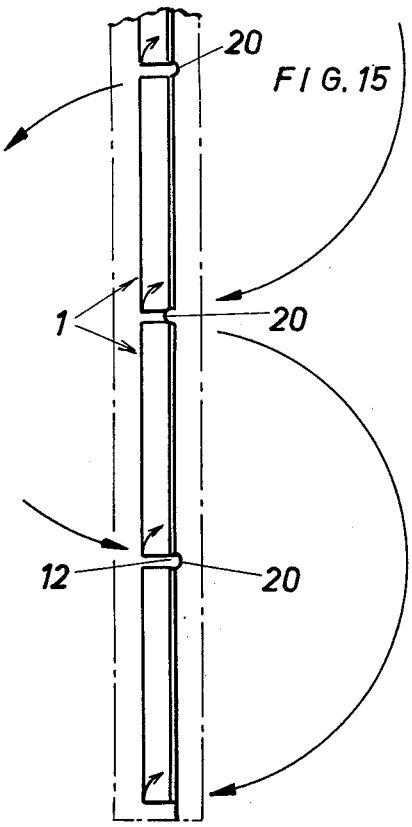
FIG. 15 shows a lateral view of a display element collapsible in both folding directions.
Figure 16:
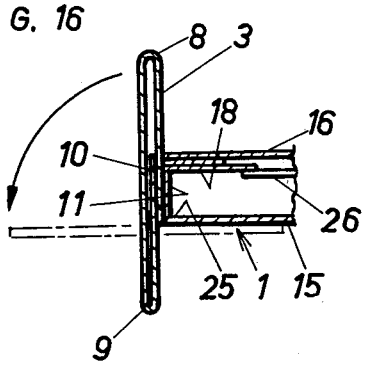
FIG. 16 shows a section through a support.

The folding of the supports 2 and 3 can be executed in one direction, for example to the rear (FIG. 14) also in this embodiment. Suitably, the height of the respectively top-positioned display carrier 1, as well as the length of the supports 2 and 3 in the zone thereof, are shortened as compared to the carriers arranged therebelow. The folding step can also be carried out alternatingly in one and the other directions, i. e. in a zig-zag shape. This folding method permits the arrangement of several display carriers 1 in direct mutual contact so that, in the unfolded condition of the display element, all display carriers 1 constitute a continuous display wall. The supports 2 and 3 can also consist of a single-layer flat material as shown in FIG. 10, instead of being shaped as a flat tubular member according to FIGS. 4, 5, and 16.

Figure 18:
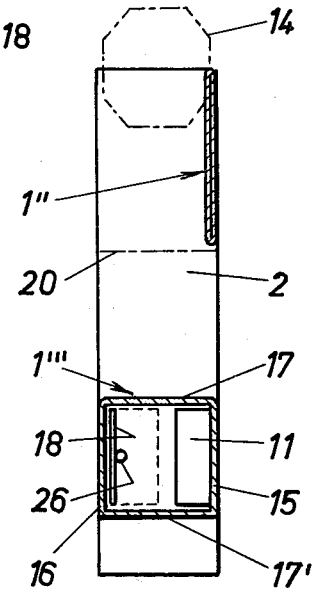
FIG. 18 shows a vertical section through the display element of FIG. 17.
Figure 17:
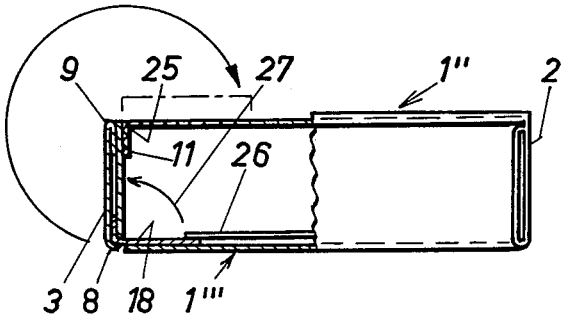
FIG. 17 shows a partially sectional top view of a display element with two differently fashioned display carriers.

The display element according to FIGS. 17 and 18 has two differently shaped display carriers 1'' and 1''' of which the display carrier 1'' is produced in the form of a flat tubular member and the other display carrier 1''' has the configuration of a collapsible box. The joints 25 between the display carriers 1'' and 1''' and the supports 2 and 3 are disposed on a longitudinal edge of these supports 2 and 3, so that the latter can be folded against the backside of the display carriers 1'' and 1''', as indicated in dot-dash lines in FIG. 17. For this reason, the length of the hingedly joined part of the connecting fishplate 18 is dimensioned so that this part contacts, during the folding step, the supports 2 and 3, respectively, i. e. does not extend laterally beyond these supports, as indicated by the arrow 27. For mounting purposes, the connecting fishplate 18 is inserted in the interior of the supports 2 and 3, respectively, and glued in place at that location. One or more joints 20 permit the collapsing of the supports 2 and 3.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

I claim:

1. A collapsible display device comprising at least one display carrier means for visibly supporting a displayed article, and at least a pair of separate support means, each arranged at opposite sides of said display carrier means for supporting said display carrier means on a surface, said display carrier means being a tubular member of a flat material, said tubular member having vertical walls defining at least one display surface and having an open end adjacent each of said pair of support means at respective sides of said vertical walls, each of said supporting means including at least one connecting tongue arranged laterally of said tubular open end at respective sides of said vertical walls, and each of said connecting tongues hingedly connecting said support means to said display carrier means to define a foldable connection of each of said support means with said display carrier means.

2. A display device according to claim 1, wherein said tubular member is a collapsible box member, said box member having said vertical walls hingedly joined with one another at respective top and bottom edges thereof by horizontal webs.

3. A display device according to claim 2, wherein said support means are elastically connected with a tension spring extending through said display carrier means.

4. A display device according to claim 3, wherein said support means are hingedly connected at two side edges of one of said vertical walls of said collapsible box member; and wherein said tension spring is attached to said support means to extend closely inside the other of said vertical walls of said collapsible box member.

5. A display device according to claim 3, wherein said tension spring is attached to connecting fishplates joined to said support means, said fishplates having approximately the length of the lateral edges of said display carrier means.

6. A display device according to claim 3, wherein said other of said vertical walls of said collapsible box member is free from connection with said support means, and the lateral edges of said other vertical wall is provided with reinforcement.

7. A display device according to claim 2, wherein at least one of said vertical walls of said collapsible box member is provided with a window-like aperture.

8. A display device according to claim 7, wherein said at least one vertical wall having said window-like aperture includes frame portions defining aperture, said frame portions having rims provided with reinforcement.

9. A display device according to claim 8, wherein respectively one tension spring extends behind said frame portion at at opposite sides of said aperture, said tension springs elastically connecting said support means.

10. A display device according to claim 9, wherein each said tension spring is arranged between said frame portion and said reinforcement, said reinforcement being folded-over extensions of said frame portion.

11. A display device according to claim 1, wherein said connecting tongues are arranged on said support means and inserted laterally into each of said open ends of said tubular member, said connecting tongues being fastened to said at least one of said vertical walls of said tubular member.

12. A display device according to claim 1, wherein said support means includes a flat tubular member of flat material, said flat tubular member having end openings arranged at respective upper and lower ends of said support means.

13. A display device according to claim 12, wherein said support means further includes base sections inserted into said lower open ends of said support means, and wherein said base sections are a flat member of a flat material and widened as compared to said support means.

14. A display device according to claim 12, wherein said support means further includes connecting members inserted into said upper open ends of said support means, and said connecting members being inserted also in said lower open ends of a second pair of said support means for supporting second display carrier means arranged above said first display carrier means, said connecting members being a flat member of a flat material.

15. A display device according to claim 1, wherein said support means are continuous and at least two of said display carrier means are arranged to be supported one above the other by said continuous support means, said support means being foldable between said two display carrier means by unilateral cutouts disposed symmetrically alternatingly on opposite sides of said support means.

16. A display device according to claim 1, wherein said flat material is folded to form said tubular member as a flat tubular member, said flat tubular member having said vertical walls connected by folds of said flat material.

17. A display device according to claim 1, wherein each of said support means includes a flat member being folded back on itself to form a flat tubular support member having a first continuous surface and a second opposing surface defined by overlapping edges of said flat member, said connecting tongues being formed by one of said edges being folded toward said open ends of said tubular display member.

18. A display device according to claim 17, wherein said connecting tongues are inserted into said open ends of said tubular display member and fastened to one of said vertical walls thereof.

19. A display device according to claim 1, wherein said support member is a flat member of a flat material, and said connecting tongues are formed by an edge of said flat member being folded toward said open ends of said tubular display carrier means.

20. A display device according to claim 1, wherein at least one display carrier means being a collapsible box member and at least one display carrier means being a flat tubular member are provided one above the other.

* * * * *